United States Patent [19]

Iwersen

[11] 4,082,099

[45] Apr. 4, 1978

[54] MACHINE FOR IDENTIFYING AND COUNTING COINS OR THE LIKE

[76] Inventor: Günter Iwersen, Angerburger Allee 551, Berlin 19, Germany

[21] Appl. No.: 731,002

[22] Filed: Oct. 8, 1976

Related U.S. Application Data

[63] Continuation of Ser. No. 566,760, Apr. 10, 1975, abandoned.

[30] Foreign Application Priority Data

Apr. 19, 1974 Germany ..... 2419597

[51] Int. Cl.[2] ..... G07D 3/16

[52] U.S. Cl. ..... 133/3 R; 133/8 R; 194/102

[58] Field of Search ..... 133/3 R, 3 E, 8 R; 194/99, 102; 209/111.7; 250/212, 222, 223 B

[56] References Cited

U.S. PATENT DOCUMENTS

| | | | |
|---|---|---|---|
| 3,389,787 | 6/1968 | Wilks | 221/277 X |
| 3,394,263 | 7/1968 | Baker | 209/111.7 X |
| 3,441,716 | 4/1969 | Lopata | 133/8 R X |
| 3,619,612 | 11/1971 | Belke | 250/212 X |
| 3,737,856 | 6/1973 | Lehrer | 250/222 R X |
| 3,754,558 | 8/1973 | Conant et al. | 133/3 R |
| 3,880,289 | 4/1975 | Gray | 250/222 R |

*Primary Examiner*—Robert B. Reeves
*Assistant Examiner*—Francis J. Bartuska
*Attorney, Agent, or Firm*—Parmelee, Johnson, Bollinger & Bramblett

[57] ABSTRACT

An apparatus for identifying and counting coins or the like comprising an optico-electronic image converter controlling a counter by means of signals analogous to the coin surfaces, which signals are fed to at least one comparator feeding the counter.

6 Claims, 2 Drawing Figures

Fig. 2

MACHINE FOR IDENTIFYING AND COUNTING COINS OR THE LIKE

This is a continuation of application Ser. No. 566,760, filed Apr. 10, 1975 now abandoned.

The invention relates to an apparatus for identifying and counting coins, coin-like tokens or the like, comprising at least one optical signal transmitter controlling a counter.

An apparatus of the aforementioned type is known, with which the coins are mechanically sorted before the counting operation proper. With this apparatus, the coins pass during the sorting operation past optical signal transmitters which are formed by photoelectric cell units and which count the number of the coins supplied by mechanical selection of certain coin containers. The known apparatus is unable to be entirely satisfactory, since the expense for a mechanical sorting is not small and there are limits to the speed thereof. An additional factor is that a conversion of the apparatus from one type of coin to another is only possible at relatively high cost.

In addition, an apparatus for identifying coins is known, with which photoelectric cell units are used for detecting or identifying the coins themselves. In this case, a plurality of photoelectric cell units are so arranged in staggered relation that they respond to coins of different diameters (German Offenlegungsschrift No. 2,334,076). Connected with this method of identification is the disadvantage that it is only suitable for detecting coins which have comparatively large differences in diamter. The reason for this is that there are limits to the concentration of the light beams of the separate photoelectric cell units and small differences in diameter cannot be detected in a satisfactory manner for technical measuring reasons. An additional defect of this detecting and identifying apparatus is to be seen in the fact that only circular coins are in practice hole to be sorted therewith and a distinction between coins having a central hole and those without a hole is only possible by using additional means.

The invention has for its object to provide an apparatus of the type initially referred to, with which it is possible by an optico-electronic method to effect a practically simultaneous sorting and counting of coins, coil-like tokens or the like of any arbitrary shape. This object is achieved according to the invention by the signal transmitting being formed by an optico-electronic image converter, past which coins are adapted to be guided and which supplies signals analogous to the respective coin surfaces, which signals are fed to at least one comparator which in its turn applies signals associated with the coins to at least one counter.

Because of the surface-measuring method which is used with the apparatus according to the invention, the latter provides the advantage of a relatively great measurement accuracy by comparison with apparatus with which the chord or the diameter of the coins to be identified is measured. Coins having the same external diameter, with and without holes, can be distinguished from one another without any difficulty and it is also possible to detect non-circular coins. The counting of the coins does not presuppose any previous sorting and as a consequence it is quite possible to dispense with a sorting of the coins.

Additional advantages of the new apparatus consist in that, with such apparatus, no exact reference edges and adjusting devices associated with the latter are required and that it can be very easily converted.

The invention is hereinafter more fully explained by reference to the accompanying drawing, wherein.

Figure 1:
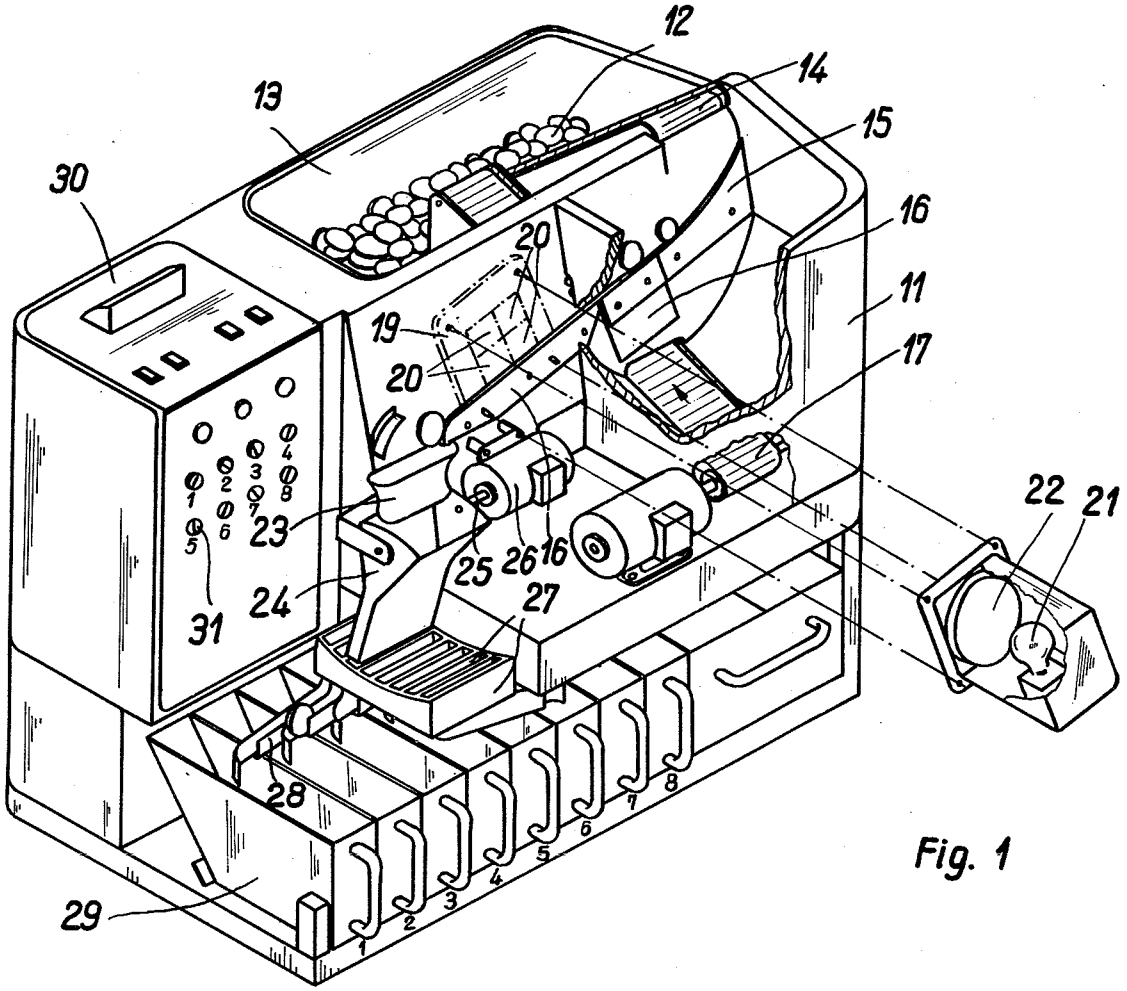
FIG. 1 is a perspective view of an apparatus according to the invention.

In FIG. 1, the reference 11 is the housing of the apparatus for identifying and counting coins 12, which are disposed in an unsorted state in a collecting trough 13. By means of a first conveyor belt 14, separate coins 12 are transferred from the collecting trough 13 to a coin-guiding rail 15, to which is connected a rocker member 16 for interrupting the guiding path for the coins. With the rocker member 16 disposed in the open position, the coins drop on to a second conveyor belt 17, which serves for the return of coins into the collecting trough 13. With the rocker member 16 closed, coins pass on to another coin-guiding rail 18, by which they are guided past an image converter 19, which consists of four solar cells 20. Arranged opposite the image converter 19 is a light source 21, the rays of which are projected by a condenser 22 on to the solar cells 20 of the image converter 19. The light source 21 and condenser 22 have not been shown in their actual position in the drawing for reasons of clarity, but they have been shown in the manner of an exploded diagram outside the apparatus.

From the coin-guiding rail 18, the coin 12 respectively identified by the image converter 19 passes by way of an intermediate chute 23 into a distributor chute 24, which is pivotally mounted on the shaft 25 of a step-by-step mechanism 26 formed by a motor. Associated with the distributor chute 24 are coin passages 27, the ends 28 of which open above coin containers 29. The reference 30 represents an electronic control means for counting coin values, for actuating the rocker member 16 and the step-by-step mechanism 26, and also for supervising the satisfactory functioning of the apparatus. This control arrangement, the construction of which is more fully explained hereafter by reference to FIG. 2, is provided with reference level adjustment devices 31, by which it is possible for the apparatus to be adapted to different purposes.

Figure 2:
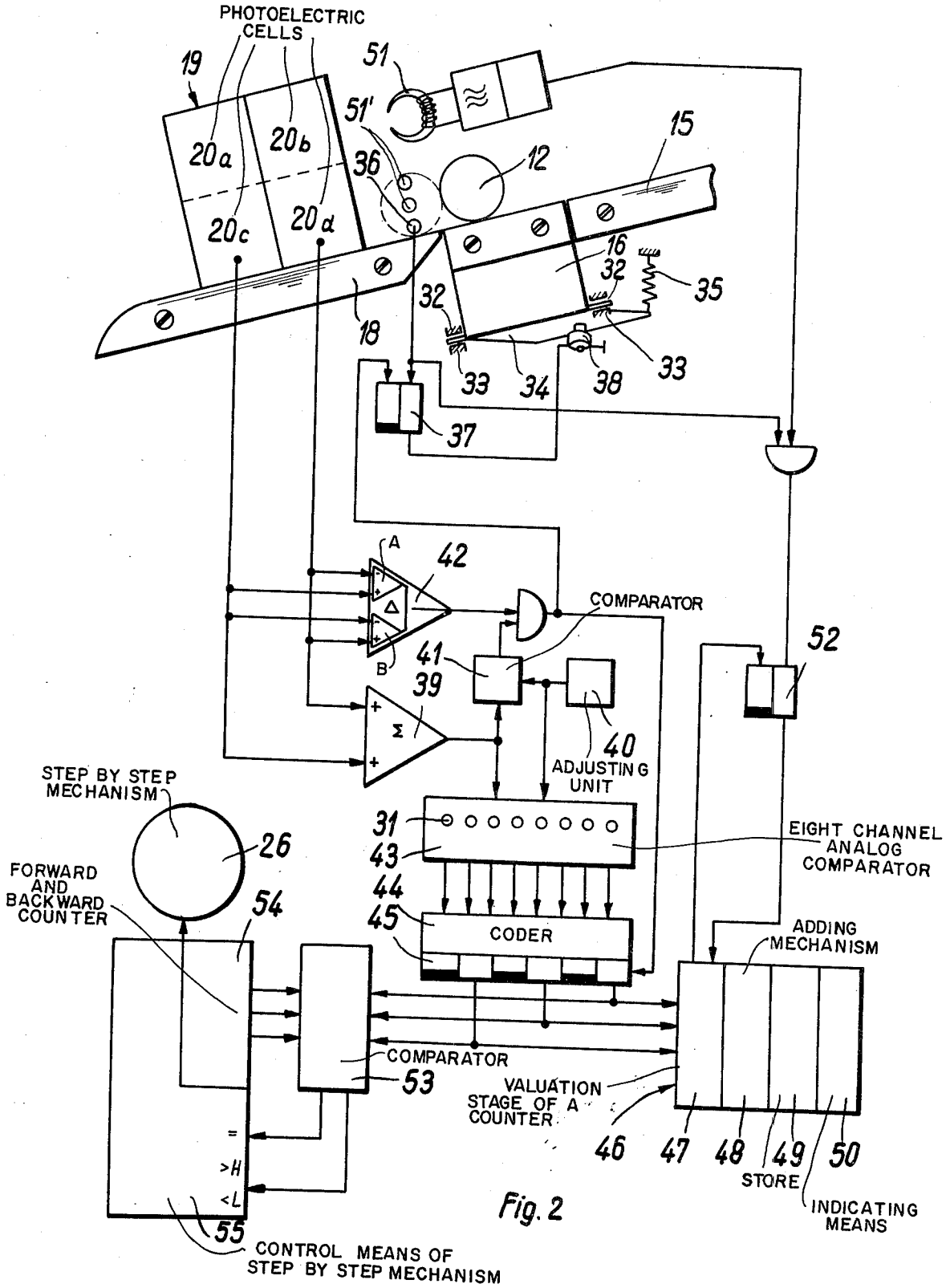
FIG. 2 shows the circuit diagram of the apparatus according to FIG. 1.

As will be seen from FIG. 2, the rocker member 16 is rotatably mounted by means of journals 32 in bearings 33. It has a projecting plate 34, which is held by a spring 35 in a rest position, in which the coins 12 are able to pass by the rocker member 16. Arranged at the front end of the coin-guiding rail 18 is a photoelectric cell unit 36, which delivers a signal to an electronic store 37 when a coin 12 passes it, which signal acts upon a rocker magnet 38, which opens the rocker member 16 and holds it open until the counting operation in respect of a coin is completed.

When a coin 12 passes the image converter 19, there is first of all an increasing concealment of the solar cells **20*d* and (with larger coins) 20*b* by the shadow image of the coin. The covering of the solar cells results in a decrease in the output voltage of a summation or adding unit 39. If the value of the adding unit 39 is below a reference level which is adjustable by an adjusting unit 40, a comparator 41 prepares for the advancing of an evaluation instruction. This advancing of the instruction takes place as soon as a zero-passage discriminator 42 passes from its L-position (L: low level) into the H-position (H: high level). This is the case when the solar cells 20c and 20d (and also possibly 20a and 20b**) are covered by equally large amounts.

The zero-passage discriminator comprises comparators A and B as shown in FIG. 2. The output voltage of photoelectric cells 20a and 20c are connected to the positive terminal of comparator A and to the negative terminal of comparator B. The output voltage of photoelectric cells 20b and 20d are connected to the negative terminal of comparator A and the positive terminal of comparator B. As coin 12 begins to roll in front of the image converter 19, solar cells 20b and 20d become increasingly more concealed, thereby decreasing the output voltage from solar cells 20b and 20d. The decreased voltage of solar cells 20b and 20d results in the output of comparator A being high and the output of comparator B being low.

When coin 12 covers equal areas of solar cells 20a and 20c and solar cells 20b and 20d (and the output voltage of solar cells 20a and 20c equals the output voltage of solar cells 20b and 20d), means are provided to activate comparator 41 to advance the evaluation instruction. In the preferred embodiment, these means are an AND circuit responsive to the output of comparators A and B.

As the coin 12 continues to roll, the output voltage of solar cells 20b and 20d continues to increase and the output voltage of solar cells 20a and 20c continues to decrease, switching the comparator A back to its low level state. When the coin is no longer blocking any of the solar cells and the zero passage discriminator is in its rest position, signals from the zero passage discriminator are blocked by the comparator 41.

Thus, the zero passage discriminator insures that the evaluation instruction will not be advanced until the coin is centrally located with respect to the image converter 19.

After delivery of the evaluation instruction, first of all the store 37 is returned to its initial position, so that the rocker magnet 38 can fall off and the rocker member 16 is brought back by the spring 35 into its bridging position. Secondly, by means of an eight-channel analogue comparator 43 and by way of a coder 44, a channel number is fed into an intermediate store 45, and in fact when and only when there is obtained voltage parity between the output voltage of the summation unit 39 and respectively a reference level adjusted by the reference level adjusting unit 31. The reference levels correspond to the normal dimensions of the coins of a coinage system.

The channel numbers are supplied to a counter 46, which has a valuation stage, an adding mechanism 48, a store 49 and an indicating means 50.

In order to prevent counting of counterfeit coins, the apparatus is in addition equipped with a metal sensor 51, by means of which it is possible to separate out coins which are of the same size but are not of the prescribed metal. The response of the metal sensor 51, the actual position of which is indicated by the circuits 51', is stored in a store 52 with the delivery of a signal through the photoelectric cell unit 36 and thereafter is taken into account with the valuation of the coins in the valuation stage 47.

The mixture of coins counted by the counter 46 can thereafter be sorted in a sorting arrangement. For this purpose, the difference between a channel number which is stored in an intermediate store 45 and the counter content of a forward and backward counter 54 is determined in a comparator stage 53. Depending on the established difference, an advance instruction is given to the control means 55 of the step-by-step mechanism 26 and the distributor chute 24 thereof is brought to above the respective coin channel 27.

I claim:

1. Apparatus for identifying and counting coins, coin-like tokens or the like comprising an optico-electronical signal transmitter past which the coins are adapted to be guided and which supplies signals corresponding to different sizes of the coins or the like to at least one counter, characterized in that the optico-electronical signal transmitter is formed by an image converter consisting of two identical cells arranged side by side in the moving direction of the coins and abutting each other along an abut joint, which cells gauge the surface of the silhouette of the respective coins and supply signals analogous to that part of the surface measured by each of them to a summation unit and a zero-passage discriminator, which discriminator when equal voltages are reached at the outputs of the cells initiates the summation unit to at least one rating comparator which in its turn feeds the counter with the rating results.

2. Apparatus according to claim 1, characterized therein that the rating comparator comprises several adjustable reference levels.

3. Apparatus according to claim 1, characterized therein that the two cells are combined in a stock pile manner with further pairs of cells, the cells of each side of the abut joint being connected in parallel.

4. Apparatus according to claim 1, characterized therein that the cells are formed by solar cells.

5. Apparatus according to claim 1 including an image converter with a linear characteristic.

6. Apparatus for identifying and counting coins, coin-like tokens or the like comprising an optico-electronical signal transmitter past which the coins are adapted to be guided and which supplies signals corresponding to different sizes of the coins or the like to at least one counter, characterized in that the optico-electronical signal transmitter is formed by an image converter comprising two identical cells arranged side by side in the moving direction of the coins and abutting each other along an abut joint, which cells gauge the surface of the silhouette of the respective coins and supply signals analogous to that part of the surface measured by each of them to a summation unit and means for initiating the summation unit to at least one rating comparator which in turn feeds the counter with the rating results, said means responsive to the output voltage of said cells and said means being activated when equal voltages are reached at the output of said cells.

* * * * *

UNITED STATES PATENT OFFICE

CERTIFICATE OF CORRECTION

Patent No. 4,082,099 Dated April 4, 1978

Inventor(s) Günter Iwersen

It is certified that error appears in the above-identified patent and that said Letters Patent are hereby corrected as shown below:

Front page - inventor's address - change "Allee 551" to -- Allee 55 --.

Column 1, Line 32 - change "diamter" to -- diameter --.

Column 1, Line 38 - change "hole" to -- able --.

Column 1, Line 45 - change "coil-like" to -- coin-like --.

Signed and Sealed this

*Fifth* Day of *February 1980*

[SEAL]

*Attest:*

SIDNEY A. DIAMOND

*Attesting Officer*

*Commissioner of Patents and Trademarks*